US005913759A

United States Patent [19]

Boström

[11] Patent Number: 5,913,759

[45] Date of Patent: Jun. 22, 1999

[54] STRETCHING APPARATUS

[76] Inventor: Bo Yngve Boström, Banergatan 45, 115 22 Stockholm, Sweden

[21] Appl. No.: 08/913,668

[22] PCT Filed: Jun. 3, 1997

[86] PCT No.: PCT/SE97/00964

§ 371 Date: Aug. 27, 1997

§ 102(e) Date: Aug. 27, 1997

[87] PCT Pub. No.: WO97/49371

PCT Pub. Date: Dec. 31, 1997

[30] Foreign Application Priority Data

Jun. 27, 1996 [SE] Sweden ..... 960250

[51] Int. Cl.[6] ..... A63B 21/00; A61H 1/02

[52] U.S. Cl. ..... 482/907; 482/142; 482/131; 601/34

[58] Field of Search ..... 482/142, 907, 482/131; 606/237, 238, 239, 240, 201–204; 601/33, 34, 135, 134; 128/845

[56] References Cited

U.S. PATENT DOCUMENTS

| | | | |
|---|---|---|---|
| 3,117,782 | 1/1964 | Johnston | 482/142 X |
| 3,834,694 | 9/1974 | Pridgen . | |
| 4,830,363 | 5/1989 | Kennedy | 482/56 |
| 5,094,444 | 3/1992 | Winkelvoss | 482/142 X |
| 5,122,106 | 6/1992 | Atwood | 482/907 X |
| 5,277,681 | 1/1994 | Holt | 482/133 X |
| 5,333,604 | 8/1994 | Green | 601/33 |
| 5,376,060 | 12/1994 | Murray | 482/56 |
| 5,421,801 | 6/1995 | Davies, III | 482/131 |
| 5,460,596 | 10/1995 | Brady . | |
| 5,584,756 | 12/1996 | Grapengiser | 482/92 |
| 5,647,823 | 7/1997 | Spence | 482/91 |

*Primary Examiner*—Richard J. Apley
*Assistant Examiner*—William LaMarca
*Attorney, Agent, or Firm*—Fasth Law Offices; Rolf Fasth

[57] ABSTRACT

Apparatus for stretching the thigh muscles on the front side of one leg (4) of a user, wherein the apparatus includes a back support bench (10, 11), a foot support (19) which lies in a region above one short end (11) of the bench in a position such that the lumbar region (7) and hip of the user (1) will lie generally flat against the bench (10, 11) when the foot of the other leg (3) rests against the foot support (19). One end of a pivotal arm (30) is pivotally mounted (31) on the apparatus and extends generally away from the short end (11) of the bench (10, 11), wherein the underside of the pivotal arm (30) is adapted to support against the upper side of the thigh of the user's one leg (4). The apparatus includes a drive motor (40, 41) which is adapted to swing the pivotal arm (30) such that when swinging downwards about its pivot axis the pivotal arm will swing said one leg (4) rearwardly such as to stretch the thigh muscles on the front side of said one leg.

9 Claims, 2 Drawing Sheets

STRETCHING APPARATUS

The present invention relates to apparatus for stretching the front thigh muscles.

Leg muscle stretching apparatus are known from U.S. Pat. Nos. 3,834,694, 5,122,106 for instance. These apparatus function to stretch the rear thigh muscles among other things. U.S. Pat. No. 5,460,596 also illustrates the present standpoint of techniques with regard to leg muscle stretching apparatus.

With certain types of exercises that involve the leg muscles, particularly the front thigh muscles (cycling, skiing) and also when sitting still for long periods of time, these muscles are temporarily shortened. This shortening of the front thigh muscles will often result in the upper body of the person concerned adopting a forward leaning position with the associated risk of said person being afflicted with back pains. In all events, it is desirable to enable a person to stretch these muscles subsequent to an exercise session or after having been in a sitting position for a long period of time, so that the person concerned is able to stand upright with no difficulty and in a natural manner without the upper part of the body leaning forwards, so as to avoid the risk of back pains, etc.

Accordingly, one object of the invention is to provide a stretching apparatus with which the thigh muscles on the front side of one thigh can be stretched.

The inventive apparatus includes a back-supporting bench and a foot support which lies in a region above one end of the bench. The foot support is placed in a position such that when the user places the foot of one leg against the foot support, the user's lumbar region and hip will lie against the flat bench. The apparatus also includes a pivotal arm which is pivotally mounted on the bench and which extends generally outwardly of and away from one short end of the bench and carries a support which is intended to lie against the front side of the other thigh of the user. The apparatus also includes a drive unit which is connected to the pivotal arm so as to enable it to be swung downwards. The drive unit may conveniently be adapted to enable the pivotal arm to perform a slow pivotal movement, wherein pivotal movement of the arm may also be limited with respect to force or torque, so as to safeguard against injury of the user when using the apparatus. The drive unit preferably coacts with a motor control means which enables the user to control the pivotal movement of the arm with respect to the angle through which the arm is swung and with respect the speed at which the arm moves, etc., with the aid of one hand. Because the user's foot rests on the foot support such that the lumbar region and hip of the user will lie against the generally flat back support bench, stretching of the thigh muscles will not result in unfavourable bending or curving of the lumbar region.

The pivotal arm may conveniently carry a support pad positioned so as to lie against the front side of the lower part of the user's other leg. When the distance from the pivot point of the pivotal arm to the pivotal arm support lying against the front side of the thigh is smaller than the distance from the pivot point to the support pad lying against the front side of the lower leg, there is afforded an advantage whereby the leg will be bent at the knee joint as the leg is swung backwards. This means that the front thigh muscles will be stretched both in the hip region and in the knee region.

The inventive apparatus will preferably be symmetrical with respect to a longitudinal plane, so as to enable the user to readily shift respective legs from the overlying foot support to the pivotal arm that lies beneath said support.

Naturally, the two pivotal arms may be connected to a common parallel pivotal movement.

The invention will now be described in more detail with reference to an exemplifying embodiment thereof and also with reference to the accompanying drawing.

Figure 1:
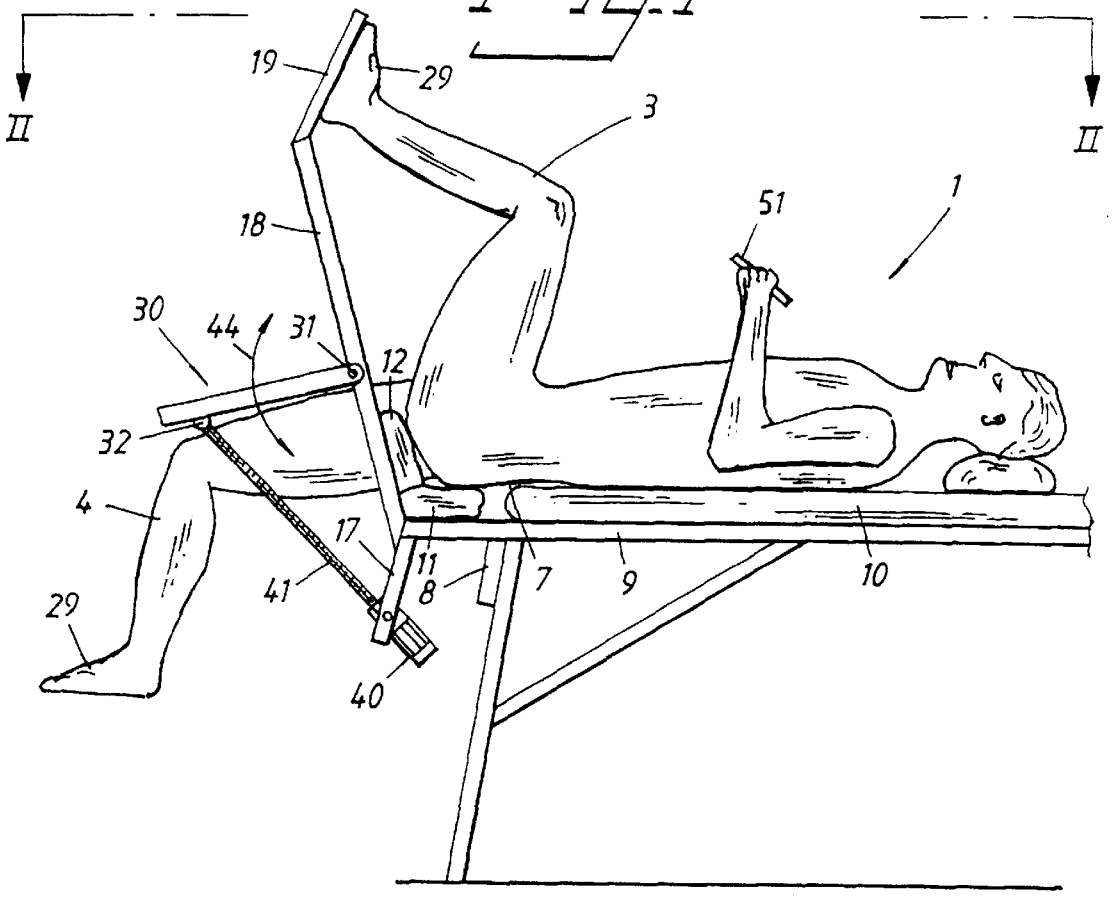
FIG. 1 is a schematic side view of an inventive apparatus with a user resting thereon.
Figure 2:
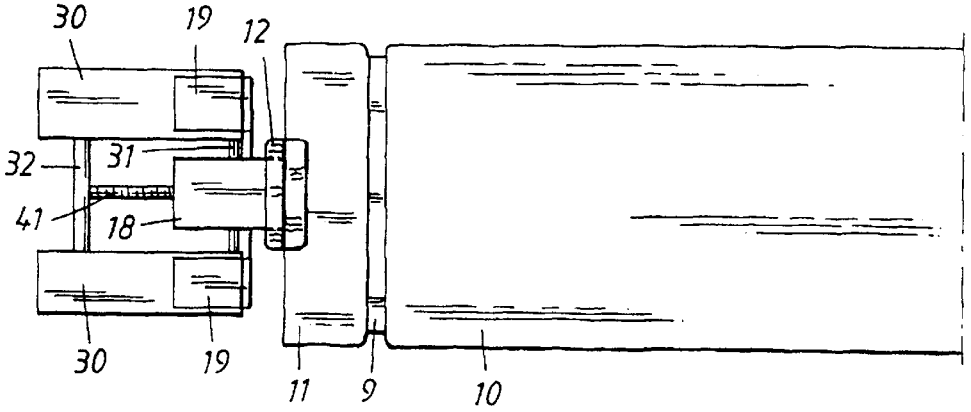
FIG. 2 is a schematic horizontal view shown from above the apparatus according to FIG. 1.

Shown in FIG. 1 is a generally horizontal bench mattress or cushion 10 on which the back of the user 1 rests. The mattress 10 is carried by a frame 9 that includes an extension, which may be vertically adjustable. The frame extension 8 is a pad 11 on which the lower hip part of the user rests, wherein a central, relatively narrow support pad 12 forms means for supporting the pelvic floor of the user. The frame part 8 also carries a central post 18 which forms a support for the support pad 12 and which carries at its upper part two laterally separated foot supports 19 on which the user's feet 29 are supported. Each foot support 19 is located in a position such that when the user places the foot 29 of one leg 3 on the support 19, his/her lumbar region 7 will lie generally in the plane established by the supports 10, 11.

Pivotally mounted on the post 18 for pivotal movement in the vertical plane about a horizontal axis 31 are two laterally spaced pivot arms 30. The pivot axis 31 is located above the support surfaces 10, 11 at a vertical distance which corresponds to the thickness of the user's thigh when the pivot arm 30 is located in a general horizontal starting position. The arm 30 is intended to lie in the proximity of the knee against the front thigh muscle of the user's other leg 4. A drive motor 40 is connected to a centre lying carrier element on the frame part 8 and includes a pull device 41 which engages with a part 32 of the arm 30 spaced from the journal 31. The drive motor 40 may include an electric motor which rotates a nut in engagement with a pull element in the form of a threaded rod 41, such as to move the nut axially and therewith establish pivotal movement 44 of the arms 30. The motor 40 may be controlled by a hand-held control unit 51 for controlling desired pivotal movement of the arms 30. The motor control unit 51 may communicate with the motor 40 or its power source in a conventional manner.

Figure 3:
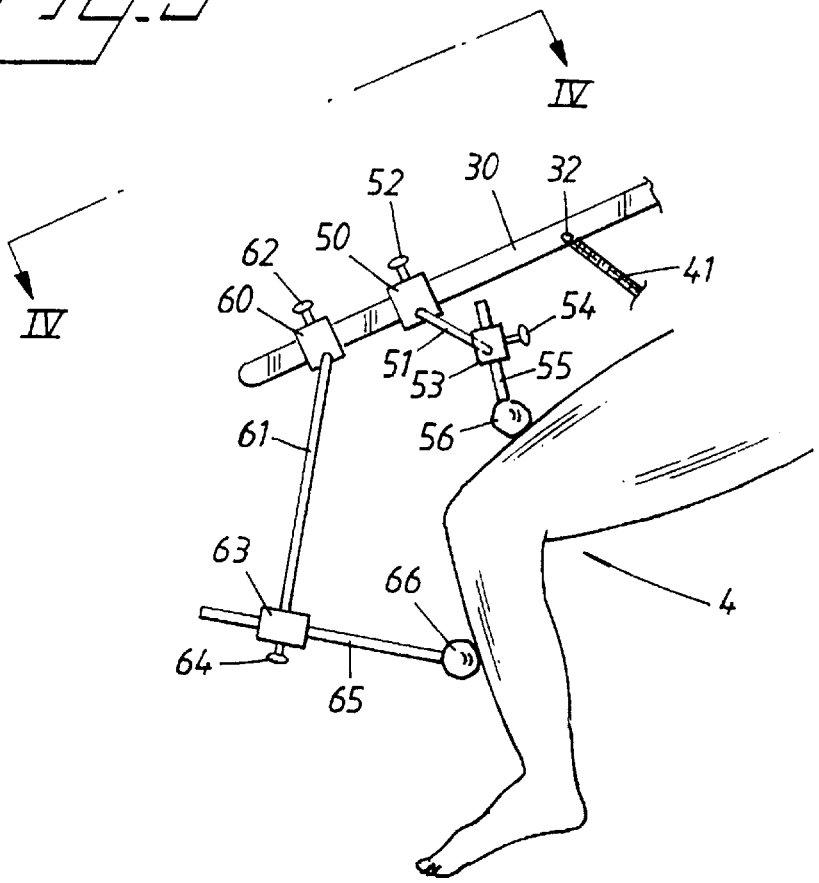
FIG. 3 is a side view of one variant of the apparatus.
Figure 4:
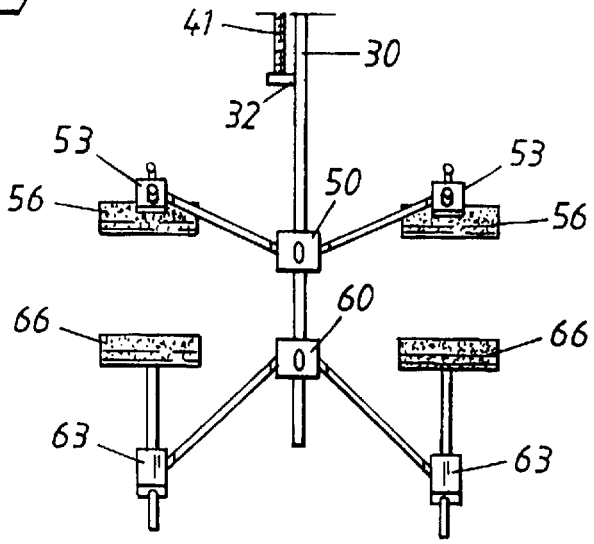
FIG. 4 is a view taken on the line IV—IV in FIG. 3.

FIGS. 3 and 4 illustrate a variant in which the pivotal arm 30 carries a first support pad 56 through the medium of a first arrangement 50–55, and a second support pad 66 through the medium of a second arrangement 60–65. The two arrangements are designed to enable the position of the pads 56, 66 to be adjusted in a vertical plane that lies parallel with the symmetry plane of the apparatus. The first pad 56 supports against the upper side of the thigh in the proximity of the knee, while the second pad 66 supports against the front side of the lower leg.

The adjustment arrangement 50–55 includes a sleeve 50 that can be moved along the arm 30 and locked in selected positions therealong, by means of a locking screw 52. The sleeve 50 carries laterally extending arms 51 which carry at their outer end a guide sleeve 53 for a rod 55 that carries the pad 56 at its bottom end, said sleeve 53 having a locking screw 54 by means of which the rod 55 can be locked in selected length positions.

The second adjustment arrangement 60–65 includes a sleeve 60 that can be moved along the arm 30 and locked in selected positions therealong by means of a locking screw 62. The sleeve 60 carries laterally extending arms 61 which carry at their outer end a guide sleeve 63 for a rod 65 that carries the pad 66 at its bottom end, said sleeve 63 having a locking screw 64 by means of which the rod 65 can be locked in selected length positions. The distance between the pivot mounting 31 of the arm 30 and the pad 56 is shorter than the distance between the pivot mounting 31 and the pad 66.

I claim:

1. An apparatus for stretching thigh muscles on a front side of a user's leg, comprising:

a back support bench having one end portion;

a first foot support in operative engagement with the back support bench so that the first foot support is disposed above the end portion;

a pivotal arm that is pivotally mounted to the foot support at a pivot point, the pivotal arm extending away from the end portion, the pivotal arm having an underside to bear against an upper side of the leg of the user; and a drive motor in operative engagement with the pivotal arm to swing the pivotal arm so that when the pivotal arm is swung downwardly the leg is swung rearwardly to stretch the thigh muscles on the front side of the leg of the user.

2. The apparatus according to claim 1 wherein the apparatus further comprises a second foot support in operative engagement with the first foot support.

3. The apparatus according to claim 1 wherein the drive motor is controllable by the user with a control mechanism.

4. The apparatus according to claim 1 wherein the apparatus comprises means for limiting a speed at which the pivotal arm swings.

5. The apparatus according to claim 1 wherein the apparatus comprises means for limiting a torque of the pivotal arm.

6. The apparatus according to claim 1 wherein the pivotal arm is in operative engagement with a first adjustment mechanism that is attached to a first support pad so that a position of the first support pad is adjustable relative to the pivotal arm.

7. The apparatus according to claim 6 wherein the apparatus comprises a second support pad that is positioned to support the front side of the leg of the user.

8. The apparatus according to claim 7 wherein the pivotal arm is in operative engagement with a second adjustment mechanism that is attached to the second support pad so that a position of the second support pad is adjustable relative to the pivotal arm.

9. The apparatus according to claim 8 wherein the first support pad is positioned a first distance from the pivot point of the pivotal arm and the second support pad is positioned a second distance from the pivot point and wherein the second distance is greater than the first distance.

* * * * *